US011259615B2

(12) United States Patent
Liu et al.

(10) Patent No.: US 11,259,615 B2
(45) Date of Patent: Mar. 1, 2022

(54) HAIR DRYER

(71) Applicants: SHENZHEN AIRGLE CORPORATION LIMITED, Guangdong (CN); AIRGLE CORPORATION, Holbrook, NY (US)

(72) Inventors: Xin Liu, Guangdong (CN); Zheng Liu, Guangdong (CN); Yong Xu, Guangdong (CN); Guanjun Long, Guangdong (CN); Lieqing Nie, Guangdong (CN); Shaoqi Shi, Guangdong (CN)

(73) Assignees: SHENZHEN AIRGLE CORPORATION LIMITED, Shenzhen (CN); AIRGLE CORPORATION, Holbrook, NY (US)

( * ) Notice: Subject to any disclaimer, the term of this patent is extended or adjusted under 35 U.S.C. 154(b) by 23 days.

(21) Appl. No.: 16/835,266

(22) Filed: Mar. 30, 2020

(65) Prior Publication Data

US 2021/0282521 A1 Sep. 16, 2021

(30) Foreign Application Priority Data

Mar. 12, 2020 (CN) ..... 202010174752.5
Mar. 12, 2020 (CN) ..... 202020310636.7

(51) Int. Cl.
*A45D 20/12* (2006.01)
*F04D 29/66* (2006.01)

(52) U.S. Cl.
CPC ..... *A45D 20/12* (2013.01); *F04D 29/668* (2013.01)

(58) Field of Classification Search
CPC ..... A45D 20/12; A45D 20/00; F04D 29/00; F04D 29/688
(Continued)

(56) References Cited

U.S. PATENT DOCUMENTS 3,860,174 A * 1/1975 Cercone ..... A45D 20/122 239/135
4,596,921 A * 6/1986 Hersh ..... F24H 3/0423 181/225
(Continued)

FOREIGN PATENT DOCUMENTS

CA 2544168 A1 * 11/2006 ..... A45D 20/12
EP 1721541 A3 * 7/2009 ..... A45D 20/12
(Continued)

OTHER PUBLICATIONS

1st Office Action of counterpart Korean Patent Application No. 10-2020-0039456 dated Jul. 23, 2021.
(Continued)

*Primary Examiner* — Stephen M Gravini

(57) ABSTRACT

The present disclosure provides a hair dryer including: a housing, having an air duct, an air inlet and an air outlet both communicated with the air duct; a fixing sleeve, arranged in the air duct of the housing, an inner wall surface of the fixing sleeve being provided with an elastic contact layer; and a fan, embedded in the fixing sleeve and abutted against the elastic contact layer. The present disclosure aims to reduce the fan vibration during the operation of the hair dryer, so as to reduce the noise generated by the hair dryer, thereby mitigating the impact of the noise on users.

8 Claims, 6 Drawing Sheets

(58) Field of Classification Search
USPC ..... 34/95–100
See application file for complete search history.

(56) References Cited

U.S. PATENT DOCUMENTS

| | | | | | |
|---|---|---|---|---|---|
| 6,058,944 | A * | 5/2000 | Porter | A45D 20/06 126/404 |
| 8,302,613 | B2 * | 11/2012 | Yde | A45D 19/02 132/272 |
| 9,420,865 | B2 * | 8/2016 | Gammack | A45D 20/10 |
| 9,512,959 | B2 * | 12/2016 | Atkinson | A45D 20/00 |
| 9,808,065 | B2 * | 11/2017 | Moloney | A45D 20/08 |
| 9,936,788 | B2 * | 4/2018 | Stephens | A45D 20/122 |
| 10,010,150 | B2 * | 7/2018 | Courtney | A45D 20/122 |
| 10,080,414 | B2 * | 9/2018 | Douglas | F16M 13/02 |
| 10,104,949 | B2 * | 10/2018 | Torres | A45D 19/16 |
| D896,439 | S * | 9/2020 | Guglielmo | D28/18 |
| 10,869,529 | B2 * | 12/2020 | Chia | A45D 20/12 |

FOREIGN PATENT DOCUMENTS

| | | | | | |
|---|---|---|---|---|---|
| GB | 2515811 | A * | 1/2015 | | A45D 20/50 |
| JP | S6465738 | A | 3/1989 | | |
| JP | H07313239 | A | 12/1995 | | |
| JP | H08228820 | A | 9/1996 | | |
| JP | H10211014 | A | 8/1998 | | |
| JP | 2006314787 | A * | 11/2006 | | A45D 20/12 |
| JP | 2014033610 | A | 2/2014 | | |
| JP | 2015013125 | A * | 1/2015 | | A45D 20/10 |
| JP | 2015013126 | A | 1/2015 | | |
| JP | 2015023798 | A | 2/2015 | | |
| JP | 2015112493 | A | 6/2015 | | |
| JP | 2016135096 | A | 7/2016 | | |
| JP | 2016526429 | A | 9/2016 | | |
| KR | 20130060391 | A | 6/2013 | | |
| KR | 101371374 | B1 | 3/2014 | | |
| KR | 20170102332 | A | 9/2017 | | |
| KR | 20180086531 | A | 7/2018 | | |
| WO | WO-2009015027 | A3 * | 1/2010 | | A45D 1/00 |

OTHER PUBLICATIONS

Notice of Reasons for Redusal of counterpart Japanese Patent Application No. 2020-058746 issued on dated Oct. 12, 2021.

* cited by examiner

HAIR DRYER

CROSS-REFERENCE TO RELATED APPLICATIONS

The present disclosure claims the benefits of and priority to Chinese Patent Application No. 202010174752.5, filed on Mar. 12, 2020, and Chinese Patent Application No. 202020310636.7, filed on Mar. 12, 2020, the entire disclosure of which are hereby incorporated by reference, in its entirety, for all that it teaches and for all purposes.

FIELD

The present disclosure relates to the field of home appliances, and more particularly relates to a hair dryer.

BACKGROUND

A hair dryer, a small domestic appliance that we use frequently in daily life, is used to enable better control over shape and style of hair. However, due to fan vibration, the hair dryer generally produces large noise during its operation, which causes noise pollution, thereby affecting user comfort.

The above content is merely used to assist in understanding the technical solutions of the present disclosure and is not intended to represent that the above content is prior art.

SUMMARY

It is an object of the present disclosure to provide a hair dryer, aiming to reduce the fan vibration during the operation of the hair dryer, so as to reduce the noise generated by the hair dryer, thereby mitigating the impact of the noise on users.

The present disclosure provides a hair dryer including:

a housing, having an air duct, an air inlet and an air outlet both communicated with the air duct;

a fixing sleeve, arranged in the air duct of the housing, an inner wall surface of the fixing sleeve being provided with an elastic contact layer; and a fan, embedded in the fixing sleeve and abutted against the elastic contact layer.

In some embodiments, the fixing sleeve includes an elastic sleeve component and a fixing sleeve component. The elastic sleeve component is configured as the elastic contact layer. The fixing sleeve component is sleeved outside the elastic sleeve component and fixedly connected with an inner wall of the housing.

In some embodiments, the elastic sleeve component includes an abutting portion and a connecting portion connected with the abutting portion. The fixing sleeve component is sleeved and fixed on an outer wall of the connecting portion, and a surface of the abutting portion facing the connecting portion is abutted against an end surface of the fixing sleeve component.

In some embodiments, a surface of the connecting portion facing the fixing sleeve component is provided with bumps. The bumps are arranged at intervals along a circumferential direction of the elastic sleeve component.

In some embodiments, the housing includes a main body and a handle. The main body is provided with the air outlet. The handle is provided with the air inlet and connected to the main body to form the air duct. The fixing sleeve is connected in the handle.

In some embodiments, the handle includes a first shell and a second shell symmetrically arranged with the first shell. The first shell and the second shell are detachably connected to clamp and fix the fixing sleeve.

In some embodiments, a central axis of the fan is coincided with a central axis of the handle in an extending direction of the handle.

In some embodiments, the hair dryer further includes a main control board, a power line, and a conductive metal sheet. The main control board is arranged in the main body and electrically connected with the fan. The power line is connected with the handle and extended out of the handle. The conductive metal sheet is fixed in the handle and configured to electrically conduct the main control board with the power line.

In some embodiments, the hair dryer further includes an operation switch, slidably arranged on the handle, located between the main body and the conductive metal sheet. The operation switch is configured to make the main control board in a conducting state or a non-conducting state with the conductive metal sheet by sliding.

In some embodiments, the hair dryer further includes an outer housing and a muffling gap. The outer housing is sleeved and fixed outside the housing. The muffling gap is defined between an outer surface of the housing and an inner surface of the outer housing.

In accordance with the present disclosure, the hair dryer includes a housing, a fixing sleeve, and a fan. The housing has an air duct, an air inlet and an air outlet both communicated with the air duct. The fixing sleeve is arranged in the air duct, and the inner wall surface of the fixing sleeve is provided with an elastic contact layer. The fan is embedded in the fixing sleeve and abutted against the elastic contact layer. As such, the fixing sleeve can fix the fan and protect the fan from falling off during the fan operation. In addition, since the fan is abutted against the elastic contact layer arranged in the fixing sleeve, the vibration caused by the high-speed movement of the fan can be absorbed by the elastic contact layer, thereby reducing the fan noise. Thus, the fixing sleeve not only can fix the fan, but also can reduce the noise generated by the hair dryer, thereby improving user comfort.

EXPLANATION OF REFERENCE NUMERAL

Figure 1:
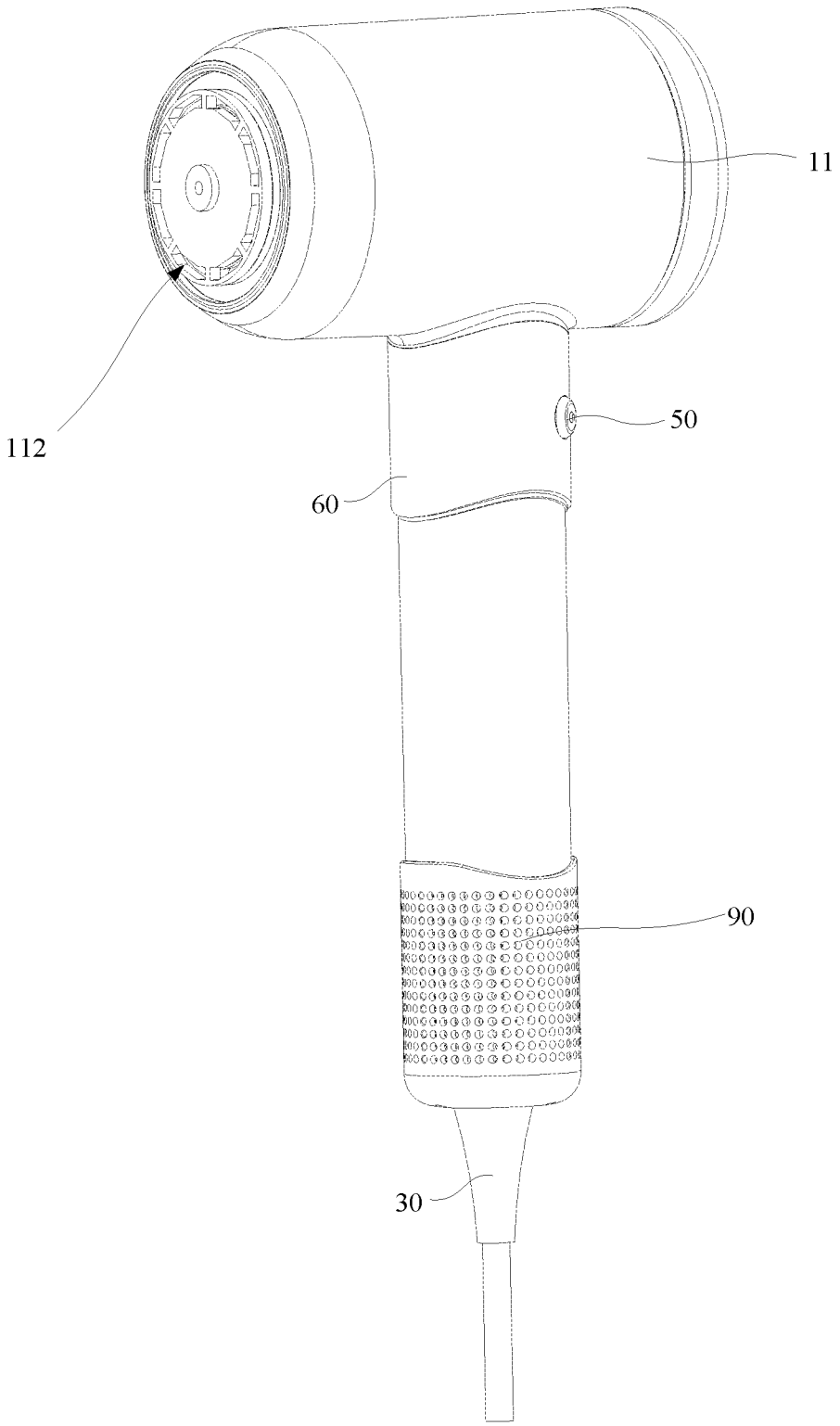
FIG. 1 is a structural view of a hair dryer according to an embodiment of the present disclosure.

| Reference numeral | Name |
|---|---|
| 100 | hair dryer |
| 10 | housing |

-continued

| Reference numeral | Name |
|---|---|
| 11 | main body |
| 112 | air outlet |
| 12 | handle |
| 121 | air inlet |
| 122 | first shell |
| 123 | second shell |
| 20 | fixing sleeve |
| 21 | elastic sleeve component |
| 211 | abutting portion |
| 212 | connecting portion |
| 2121 | bump |
| 22 | fixing sleeve component |
| 30 | power line |
| 40 | conductive metal sheet |
| 50 | operation switch |
| 60 | outer housing |
| 70 | muffling gap |
| 80 | first filter sleeve |
| 90 | second filter sleeve |

The realizing of the aim, functional characteristics and advantages of the present disclosure are further described in detail with reference to the accompanying drawings and the embodiments.

DETAILED DESCRIPTION OF THE EMBODIMENTS

The technical solutions in the embodiments of the present disclosure will be described clearly and completely combining the drawings in the embodiments of the present disclosure. Obviously, the described embodiments are only a part of the embodiments of the present disclosure, but not all of them. Based on the embodiments in the present disclosure, all other embodiments obtained by those skilled in the art without creative work shall belong to the protection scope of the present disclosure.

It should be understand that, all directional indications (such as "upper", "lower", "left", "right", "front", "back" . . . ) in the embodiments of the present disclosure are only used to explain the relative positional relationship, motion, and the like, between components in a certain posture. If the particular posture changes, the directional indication changes accordingly.

In the present disclosure, unless specified or limited otherwise, the terms "connected", "fixed" and the like are used broadly, and may be, for example, fixed connections, detachable connections, or integral connections; may also be mechanical or electrical connections; may also be direct connections or indirect connections via intervening structures; may also be inner communications of two elements or interactions of two elements, which could be understood by those skilled in the art according to specific situations.

Moreover, terms such as "first" and "second" are used herein for purposes of description and are not intended to indicate or imply relative importance or to imply the number of indicated technical features. Thus, the features defined with "first" and "second" may comprise or imply at least one of these features. In the description of the present disclosure, "a plurality of" means two or more than two, unless specified otherwise. In addition, the meaning of the term "and/or" appearing throughout the disclosure is that it includes three solutions, taking "A and/or B as examples", including solution A, or solution B, or solutions that A and B combined. The technical solutions between the various embodiments can be combined with each other, but must be based on those that can be realized by the person skilled in the art. If the combination of technical solutions conflicts or cannot be achieved, it should be considered that such a combination of technical solutions does not exist, which is also not within the protection scope claimed by the present disclosure.

The present disclosure provides a hair dryer 100.

In some embodiments, referring to FIGS. 1 to 4, the hair dryer 100 includes a housing 10, a fixing sleeve 20, and a fan (not shown). Inside the housing 10 is formed with an air duct. The housing 10 is provided with an air inlet 121 and an air outlet 112 both communicated with the air duct. The fixing sleeve 20 is connected in the housing 10 and located in the air duct of the housing 10. Besides, the inner wall surface of the fixing sleeve 20 is provided with an elastic contact layer. The fan is embedded in the fixing sleeve 20 and abutted against the elastic contact layer.

Specifically, the fan may be operated as that a motor drives blades to rotate, sucking external air into the air duct. The speed of the motor may reach up to 100,000 rpm, so as to generate strong airflow and as a result ensure a strong wind pressure at a large air volume. It should be noted that the speed of the fan may be selected by those skilled in the art according to actual needs. The housing 10 may be made of plastic material, such as acrylonitrile-butadiene-styrene (ABS), polyformaldehyde (POM), polystyrene (PS), polymethyl methacrylate (PMMA), polycarbonate (PC), polyethylene terephthalate (PET), etc. The insulation material can protect users from an electric shock when they are holding the housing 10, thus increasing the operation safety of the hair dryer 100. It will be appreciated that since the elastic contact layer mainly effects in reducing the fan vibration, the thickness of the elastic contact layer may be selected by those skilled in the art, which is not detailed herein.

In the present disclosure, the hair dryer 100 includes a housing 10, a fixing sleeve 20, and a fan. The housing 10 has an air duct, an air inlet 121 and an air outlet 112 both communicated with the air duct. The fixing sleeve 20 is located in the air duct of the housing 10, and an inner wall surface of the fixing sleeve 20 is provided with an elastic contact layer. The fan is embedded in the fixing sleeve 20 and abutted against the elastic contact layer. As such, the fixing sleeve 20 can fix the fan to protect it from falling off during its operation. In addition, since the fan is abutted against the elastic contact layer disposed in the fixing sleeve 20, the vibration caused by the high-speed movement of the fan can be absorbed by the elastic contact layer, thereby reducing the fan noise. Thus, the fixing sleeve 20 not only can fix the fan, but also can reduce the noise generated by the hair dryer 100, thereby improving user comfort.

Figure 3:
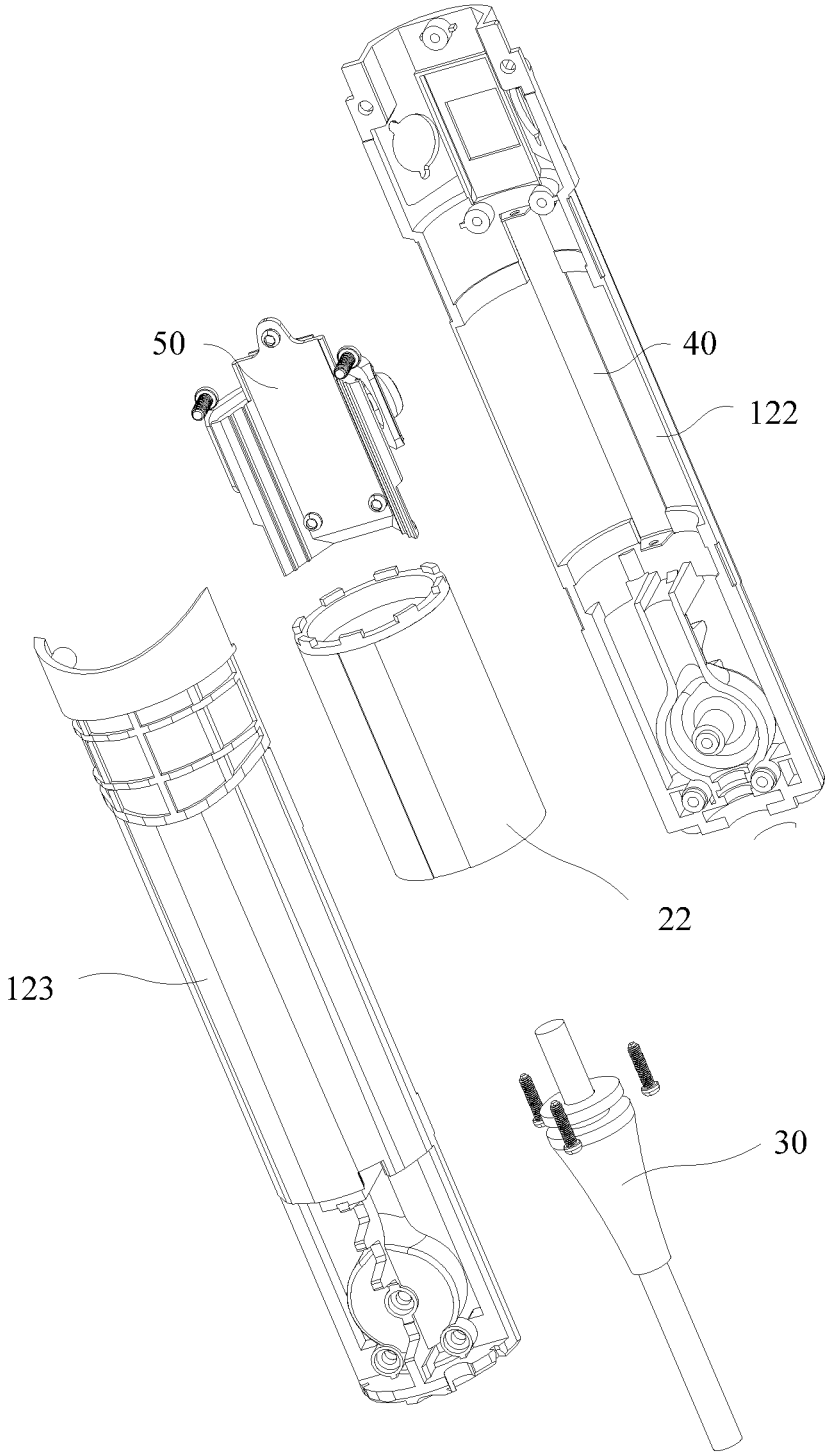
FIG. 3 is an assembly structural view of part of a hair dryer according to an embodiment of the present disclosure.
Figure 4:
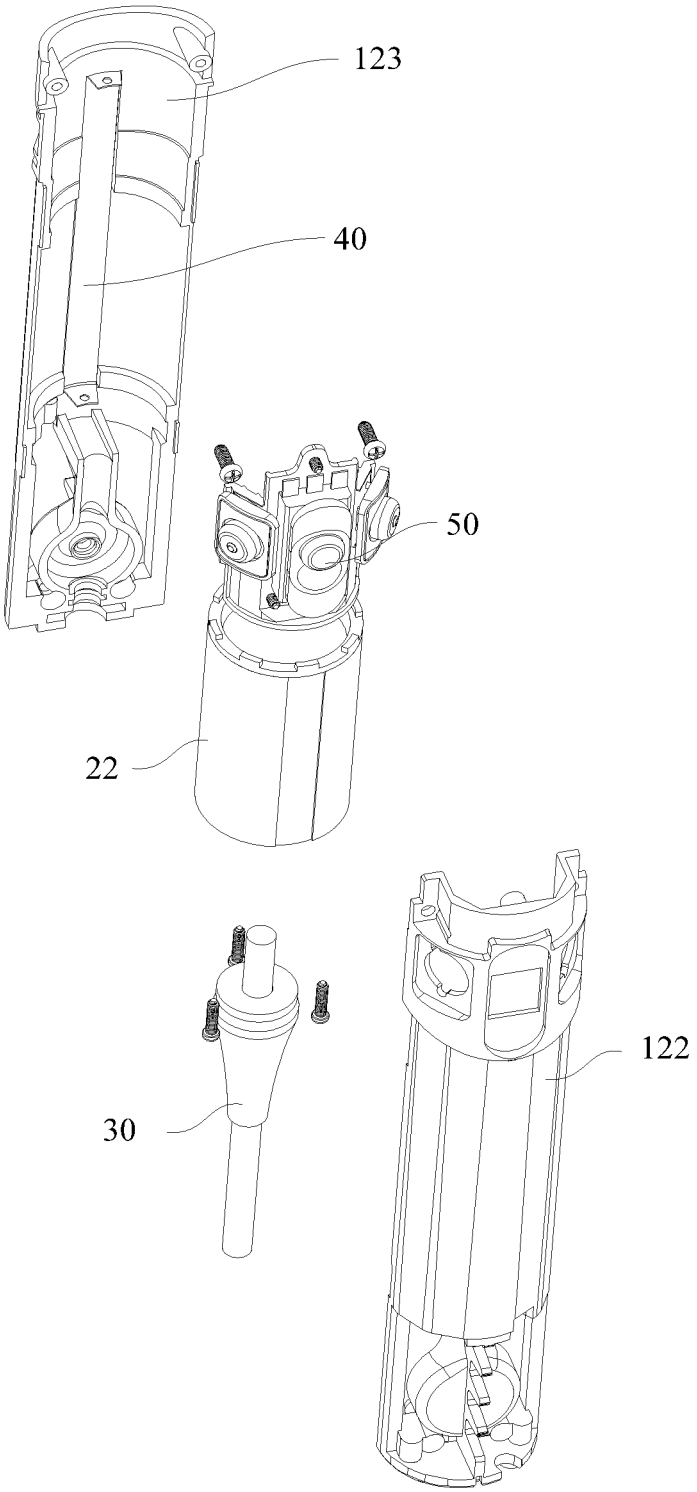
FIG. 4 is similar to FIG. 3, but shown from another view.
Figure 6:
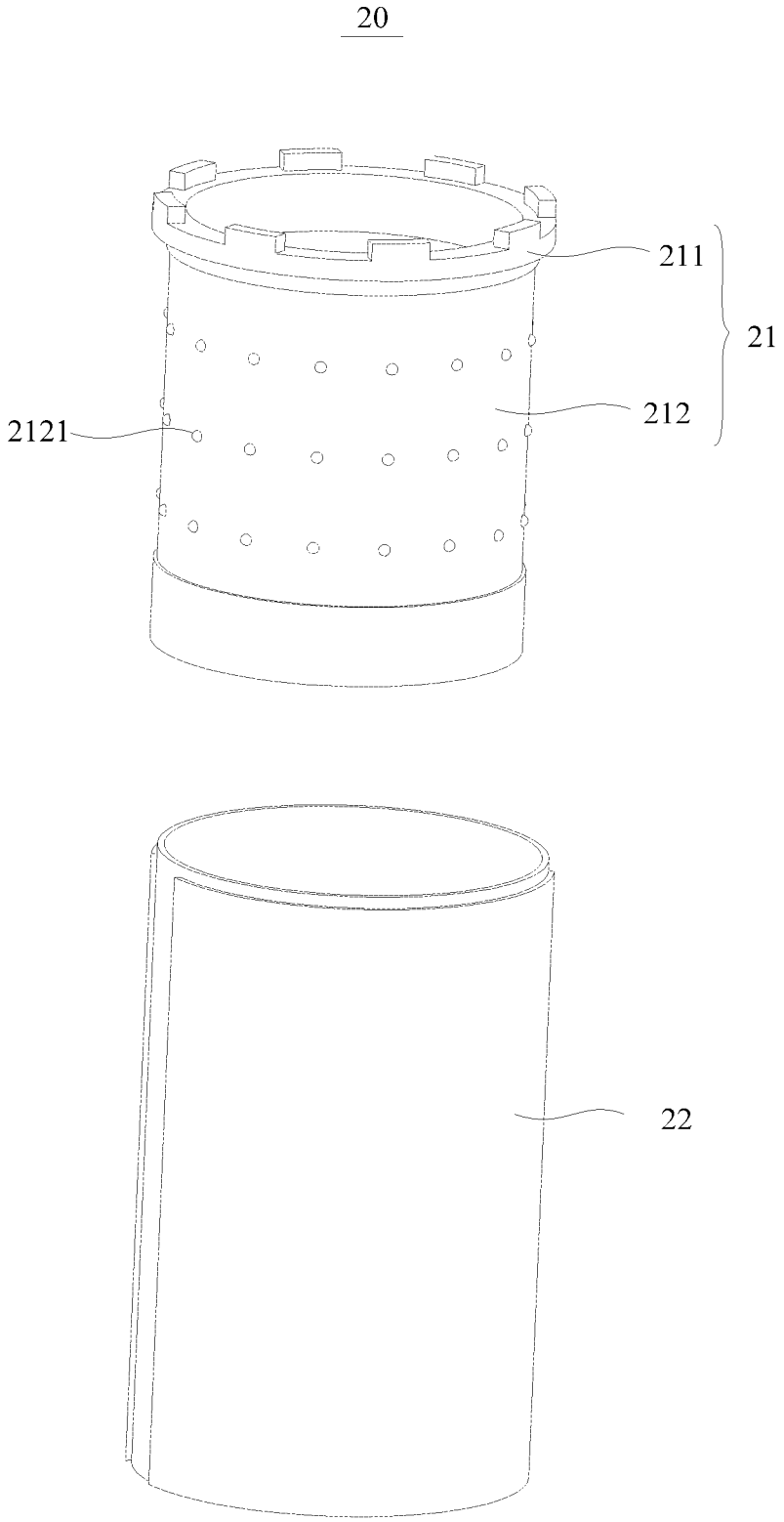
FIG. 6 is an assembly structural view of a fixing sleeve of a hair dryer according to an embodiment of the present disclosure.

In some embodiments, referring to FIGS. 3-4 and 6, the fixing sleeve 20 includes an elastic sleeve component 21 and a fixing sleeve component 22. The elastic sleeve component 21 is formed as the elastic contact layer. The fixing sleeve component 22 is sleeved outside the elastic sleeve component 21 and fixedly connected to the inner wall of the housing 10. Specifically, the elastic sleeve component 21 and the fixing sleeve component 22 may be arranged separately, and are connected together by sleeving the fixing sleeve component 22 outside the elastic sleeve component 21, which facilitates maintenance and replacement. The elastic sleeve component 21 may be made of elastic material such as silicone or rubber for reducing the vibration of the fan fixed in the elastic sleeve component 21. The fixing sleeve component 22 may be made of material with hardness such as plastic, and be directly fixed in the housing 10, so as to provide a stable support for the fan. It will be appreciated that the elastic sleeve component 21 and the fixing sleeve component 22 may be formed as an integrated structure, which thereby saves the assembly process. The specific structure may be selected by those skilled in the art, and is not detailed herein.

In some embodiments, the elastic sleeve component 21 includes an abutting portion 211 and a connecting portion 212 connected with the abutting portion 211. The fixing sleeve component 22 is sleeved and fixed on an outer wall of the connecting portion 212. A surface of the abutting portion 211 facing the connecting portion 212 is abutted against an end surface of the fixing sleeve component 22. The abutting portion 211 and the connecting portion 212 may be formed as an integrated structure by injection molding, which not only omits the installation process, but also ensures strength of the elastic sleeve component 21. By abutting the surface of the abutting portion 211 facing the connecting portion 212 against the end surface of the fixing sleeve component 22, the installation and positioning of the elastic sleeve component 21 can be more convenient and accurate. Also, this abutment can prevent the situation that the elastic sleeve component 21 is completely embedded in the fixing sleeve component 22 and cannot be detached.

In some embodiments, the surface of the connecting portion 212 facing the fixing sleeve component 22 is provided with bumps 2121 arranged at intervals along a circumferential direction of the elastic sleeve component 21. The arrangement of the plurality of bumps 2121 makes the connecting portion 212 spaced from the fixing sleeve component 22 to form a gap therebetween, such that the noise generated by the fan variation can spread through the gap, which thereby reduces the loudness of the noise. In addition, the arrangement of the plurality of bumps 2121 makes the elastic sleeve component 21 easier to deform with respect to the fixing sleeve component 22, thus further reducing the fan vibration.

In some embodiments, referring to FIGS. 1 to 4, the housing 10 includes a main body 11 and a handle 12. The main body 11 is provided with the air outlet 112, and the handle 12 is provided with the air inlet 121. The main body 11 is connected with the handle 12 to cooperate to form the air duct. The fixing sleeve 20 is connected inside the handle 12. The main body 11 is provided with a heating wire and a control circuit, and so on. By arranging the air inlet 121 on the handle 12 and arranging the air outlet 112 on the main body 11, the air duct is allowed to be long enough, and external fluid after entering the hair dryer 100 can accordingly be heated for a time sufficient. By arranging the fan inside the handle 12, the weight of the main body 11 is effectively reduced, thus the hair dryer 100 as a whole is more stable when being held by users. Furthermore, by arranging the fan in the handle 12, the center of gravity of the hair dryer 100 is located at the handle 12, and as a result, the hair dryer 100 is more stable when being held by users, thereby guaranteeing the operation safety of the hair dryer 100.

In some embodiments, the hair dryer 100 further includes a first filter sleeve 80 and a second filter sleeve 90. Both of the first filter sleeve 80 and the second filter sleeve 90 are provided with filter holes. The first filter sleeve 80 and the second filter sleeve 90 are cooperated to form a multi-layer filter, which improves the effect of fluid filtration. Specifically, the first filter sleeve 80 is fixed to the handle 12 and configured to cover the air inlet 121; the second filter sleeve 90 is connected with the handle 12 by means of a screw or a snap. When the second filter sleeve 90 is connected with the handle 12, since the inner surface of the second filter sleeve 90 can be abutted against with the outer surface of the first filter sleeve 80, fixing the second filter sleeve 90 can simultaneously fix the first filter sleeve 80 in a limited position, such that the first filter sleeve 80 and the second filter sleeve 90 can be simultaneously fixed, thus ensuring the stability of the overall structure of the hair dryer 100.

In some embodiments, the handle 12 includes a first shell 122 and a second shell 123 symmetrically disposed. The first shell 122 and the second shell 123 are detachably connected to clamp and fix the fixing sleeve 20. Specifically, each of the first shell 122 and the second shell 123 may be an arc-shaped shell 10. The two are-shaped shells 10 are connected to make the handle 12 in a cylindrical shape, such that the handle 12 is convenient for users to hold. The first shell 122 and the second shell 123 may be connected by means of a snap or a screw, which is convenient for installation and detachment. Besides, the connected first shell 122 and the second shell 123 can clamp and fix the fixing sleeve 20, thereby ensuring the stability of the fixing sleeve 20 installed in the handle 12.

In some embodiments, the central axis of the fan is coincided with the central axis of the handle 12, in an extending direction of the handle 12. Specifically, the extending direction of the handle 12 is a length direction of the handle 12. In the process of using the hair dryer 100, in case where the fan speed exceeds 50,000 rpm, if the central axis of the fan is not coincided with the central axis of the handle 12, a centrifugal force will be generated, and users need to apply more force to overcome this centrifugal force. Instead, if the central axis of the fan is coincided with the central axis of the handle 12, the centrifugal force will not be generated, so that users are not required to apply more force to hold the hair dryer 100, thereby improving the comfort for users holding the handle 12.

In some embodiments, referring to FIGS. 3 and 4, the hair dryer 100 further includes a main control board (not shown), a power line 30, and a conductive metal sheet 40. The main control board is disposed in the main body 11 and electrically connected to the fan. The power line 30 is connected to the handle 12 and extended out of the handle 12. The conductive metal sheet 40 is fixed within the handle 12 and configured to conduct the main control board to the power line 30. The main control board may be a PCB circuit board, electrically controlling electrical components in the hair dryer 100. One end of the conductive metal sheet 40 may be electrically connected with the PCB circuit board, and the other end is electrically connected with the power line 30, so as to conduct the PCB circuit board to the power line 30. In case where the PCB circuit board is disposed far from the conductive metal sheet 40, a short section of a wire may be provided to conduct the PCB circuit board to the conductive metal sheet 40. Due to the flexibility of the wire, it can be deformably disposed in the housing 10, thereby adapting to the situation where the PCB circuit board and the conductive metal sheet 40 are far away. By arranging the conductive metal sheet 40 for electrical conduction, there is no need to install multiple cables in the handle 12, which thereby not only saves wiring space in the hair dryer 100, but also provides a stable installation of the fixing sleeve 20 inside the handle 12. In addition, the conductive metal sheet 40 will not affect the maintenance operation when detaching the hair dryer 100. Specifically, the conductive metal sheet 40 is fixedly attached to the inner surface of the handle 12, or partially embedded in the handle 12, such that the conductive metal sheet 40 is not easy to shake during the operation of the hair dryer 100, thereby improving the usability of the hair dryer 100. Alternatively or optionally, the conductive metal sheet 40 is fixed on the outside of the fixing sleeve 20, so that the conductive metal sheet 40 can be fixed when the fixing sleeve 20 is fixed. The specific manner is not detailed herein.

In some embodiments, the hair dryer 100 further includes an operation switch 50 slidably arranged on the handle 12 and located between the main body 11 and the conductive metal sheet 40. The operation switch 50 is configured to make the main control board in a conducting state or in a non-conducting state with the conductive metal sheet 40 by sliding. Specifically, the operation switch 50 is arranged at a through hole of the first shell 122. Two ends of the operation switch 50 are connecting ends movable with respect to the handle 12. One of the connecting ends is always in the conducting state with the main body 11, and the other connecting end is in the non-conducting state with the conductive metal sheet 40. When a user slides the operation switch 50 to make the connecting end of the operation switch 50 away from the main body 11 abutted against the conductive metal sheet 40, the operation switch 50 is electrically conducted with the conductive metal sheet 40, and accordingly the main body 11 and the conductive metal sheet 40 are in the conducting state, and which realizes the normal operation of the hair dryer 100. When the operation switch 50 slides to its initial position, the operation switch 50 is separated from the conductive metal sheet 40, and accordingly the main body 11 and the conductive metal sheet 40 are in the non-conducting state, and which stops the operation of the hair dryer 100. Thus, the hair dryer 100 can be controlled to be on and off simply by users sliding the operation switch 50, which is convenient to operate. In some embodiments, the operation switch 50 is always connected with the conductive metal sheet 40, and is configured to slide to be abutted against or separated from the main body 11, so as to control switching between the conducting and the non-conducting states of the main body 11 and the conductive metal sheet 40. It should be noted that the operation switch 50 may also be connected to the main control board for adjusting wind speed and temperature, and this may be selected by those skilled in the art according to actual needs.

Figure 2:
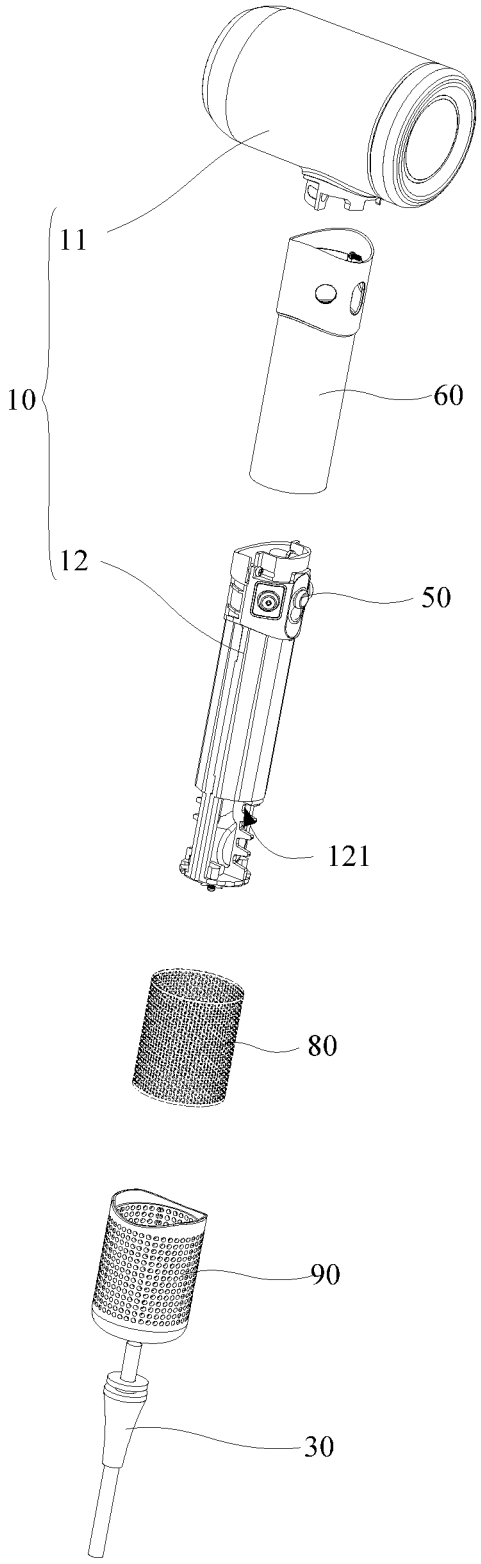
FIG. 2 is an exploded structural view of a hair dryer according to an embodiment of the present disclosure.
Figure 5:
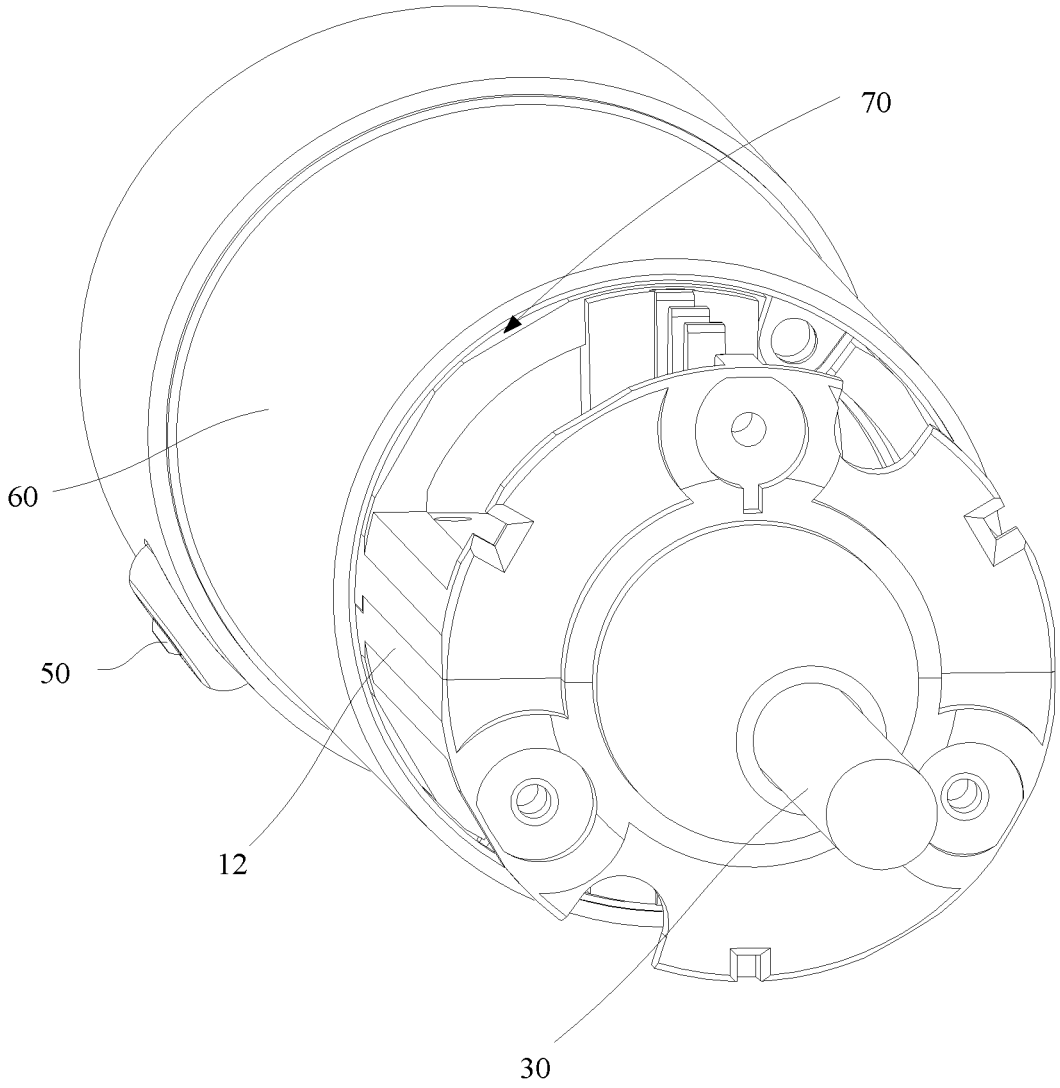
FIG. 5 is a structural view of an outer housing and a handle of a hair dryer according to an embodiment of the present disclosure.

In some embodiments, referring to FIGS. 2 and 5, the hair dryer 100 further includes an outer housing 60. The outer housing 60 is sleeved and fixed outside the housing 10. Besides, a muffling gap 70 is formed between the outer surface of the housing 10 and the inner surface of the outer housing 60. As such, the sound generated during the fan operation passes through the housing 10, the muffling gap 70, the outer housing 60, and finally to the external environment. During this process, the sound spreads in the air when passing through the muffling gap 70, and as a result the loudness of the sound can be reduced and the loudness transmitted to the external environment is smaller. Thus, the noise of the hair dryer 100 can be effectively reduced, thereby improving the comfort for users using the hair dryer 100.

The foregoing description merely portrays some illustrative embodiments in accordance with the disclosure and therefore is not intended to limit the patentable scope of the disclosure. Any equivalent structure or flow transformations that are made taking advantage of the specification and accompanying drawings of the disclosure and any direct or indirect applications thereof in other related technical fields shall all fall in the scope of protection of the disclosure.

What is claimed is:

1. A hair dryer comprising:

a housing, having an air duct, an air inlet and an air outlet both communicated with the air duct;

a fixing sleeve, arranged in the air duct of the housing, an inner wall surface of the fixing sleeve being provided with an elastic contact layer; and a fan, embedded in the fixing sleeve and abutted against the elastic contact layer;

wherein the fixing sleeve comprises an elastic sleeve component and a fixing sleeve component;

the elastic sleeve component is configured as the elastic contact layer, and comprises an abutting portion and a connecting portion connected with the abutting portion;

the fixing sleeve component is sleeved outside the elastic sleeve component, and is fixedly connected with an inner wall of the housing; and the fixing sleeve component is sleeved and fixed on an outer wall of the connecting portion, and a surface of the abutting portion facing the connecting portion is abutted against an end surface of the fixing sleeve component.

2. The hair dryer according to claim 1, wherein a surface of the connecting portion facing the fixing sleeve component is provided with bumps, the bumps being arranged at intervals along a circumferential direction of the elastic sleeve component.

3. The hair dryer according to claim 2, wherein the housing comprises:

a main body, provided with the air outlet; and a handle, provided with the air inlet and connected to the main body to form the air duct;

wherein the fixing sleeve is connected in the handle.

4. The hair dryer according to claim 3, wherein the handle comprises:

a first shell and a second shell symmetrically arranged with the first shell;

wherein the first shell and the second shell are detachably connected to clamp and fix the fixing sleeve.

5. The hair dryer according to claim 3, wherein a central axis of the fan is coincided with a central axis of the handle in an extending direction of the handle.

6. The hair dryer according to claim 3, wherein the hair dryer further comprises:

a main control board, arranged in the main body and electrically connected with the fan;

a power line, connected with the handle and extended out of the handle; and a conductive metal sheet, fixed in the handle and configured to electrically conduct the main control board with the power line.

7. The hair dryer according to claim 6, wherein the hair dryer further comprises:

an operation switch, slidably arranged on the handle, located between the main body and the conductive metal sheet, and configured to make the main control board in a conducting state or a non-conducting state with the conductive metal sheet by sliding.

8. The hair dryer according to claim 7, wherein the hair dryer further comprises:

an outer housing, sleeved and fixed outside the housing; and a muffling gap, defined between an outer surface of the housing and an inner surface of the outer housing.

* * * * *